US006315365B1

(12) United States Patent
Gerer et al.

(10) Patent No.: US 6,315,365 B1
(45) Date of Patent: Nov. 13, 2001

(54) MINING MACHINE WITH CORE BREAKERS

(75) Inventors: Roman Gerer; Eduard Krivec, both of Zeltweg; Kurt Schaffer, Seckau, all of (AT)

(73) Assignee: Tamrock Voest-Alphien Bergtechnik Gesellschaft m.b.H. (AT)

( * ) Notice: Subject to any disclaimer, the term of this patent is extended or adjusted under 35 U.S.C. 154(b) by 0 days.

(21) Appl. No.: 09/432,765

(22) Filed: Nov. 3, 1999

(30) Foreign Application Priority Data

Nov. 4, 1998 (AT) ..... 1833/98

(51) Int. Cl.[7] ..... E21C 25/10

(52) U.S. Cl. ..... 299/78; 299/79.1; 299/101; 299/85.1

(58) Field of Search ..... 299/78, 79.1, 76, 299/85.1, 101, 112

(56) References Cited

U.S. PATENT DOCUMENTS 2,808,253 * 10/1957 Miller ..... 299/76
3,010,709 * 11/1961 Bentley et al. ..... 299/102
3,279,856 * 10/1966 Silks ..... 299/76
3,290,099 * 12/1966 Lundquist ..... 299/79.1
4,253,705 3/1981 LeBegue .
4,391,472 * 7/1983 Krekeler ..... 299/85.1
4,637,658 * 1/1987 Annipajo et al. ..... 299/79
4,669,786 * 6/1987 Morgan et al. ..... 299/76
5,297,856 * 3/1994 Sollami ..... 299/79
5,338,104 * 8/1994 Bewick ..... 299/85.1

* cited by examiner

*Primary Examiner*—David Bagnell
*Assistant Examiner*—John Kreck

(57) ABSTRACT

In a driving or mining machine including cutter rolls or drums which are mounted for rotation on a cantilever arm pivotable in the vertical direction, bearings and/or gears are arranged in the axial direction of the cutter rolls or drums between parts of the rolls or drums. The bearings and/or gears are connected with the cantilever arm or an actuating means provided in the cantilever arm. At least one stationary cutter bit is arranged on the cantilever arm in the region of the bearings and/or gears between neighboring parts of the rolls or drums in a plane through which the axis of the cantilever arm passes. The cutter bit has at least two cutting edges, a first cutting edge being provided substantially tangential to the enveloping curve of the rotating bits in the direction of the axis of the cantilever arm and a second cutting edge being provided so as to enclose an angle with the first cutting edge.

11 Claims, 5 Drawing Sheets

MINING MACHINE WITH CORE BREAKERS

BACKGROUND OF THE INVENTION

1. Field of the Invention

The invention relates to a driving or mining machine comprising cutter rolls or drums rotatably mounted on a cantilever arm pivotable in the vertical direction, in which bearings and/or gears are arranged in the axial direction of the cutter rolls or drums between parts of the rolls or drums, which bearings and/or gears are connected with the cantilever arm or the actuating means provided in the cantilever arm.

2. Prior Art

With roll cutter machines of the initially defined kind, the mine face, as a rule, is worked by initially moving the cutter roll or drum in the direction towards the mine face and into the mine face, whereupon the mine face is worked by vertically pivoting the cantilever arm carrying the cutter rolls. Due to the mounting and the transmission of the rotary drive onto the rolls, a material rib will each be left between neighboring roll parts or drums by such a driving or mining machine, which in most cases is referred to as a core. If there is sufficiently crumbly material, it is usually possible to break up the cores left in the region of the mine face by moving the cutting tools further in the direction towards the mine face. With tougher rocks, the removal of such cores is cumbersome and not readily feasible without additional measures. Such a material core, as a rule, is left, in particular, in the region of the roof and consequently will hamper headway timbering, impeding the perfect attachment of covering plates and the perfect arrangement of roof elements.

In order to remove or break up such cores, so-called core breakers have already been proposed, which were stationarily arranged on a support. Such a configuration may be taken, for instance, from U.S. Pat. No. 3,279,856, in which a U-shaped support carries a circumferential continuous splitter edge mounted to the gear case in the region of the core.

Alternatively, it has already been suggested to arrange, in the region of the core, bits which are more or less difficult to pivot, such arrangements being characterized by relatively high structural expenses and the fact that the subsequent equipment of cutter rolls with such devices is not readily feasible.

In addition to a continuous splitter edge extending in the circumferential direction as proposed in U.S. Pat. No. 3,279,856, it has, moreover, already been proposed to arrange a plurality of individual bits and, in particular, replaceable parallel shank bits on a support fixed to the cantilever arm in the region of the core. Such a configuration may be taken, for instance, from U.S. Pat. No. 4,669,786. Due to the use of parallel shank cutters and the fact that such cutters were arranged at a radial distance from the axis of rotation of the rolls substantially smaller than the radial distance from the actual cutter bits of the rolls or drums, a core likewise would remain in such configurations at least in the region of the roof, the further disintegration of which core was not readily feasible. Further, U.S. Pat. No. 4,253,705 proposed an obliquely extending breaking edge in the region of the core, via which the core forming on the mine face was to be broken by lateral pressure.

SUMMARY OF THE INVENTION

The invention aims at providing a simple device easy to retrofit, by which primarily the core remaining in the region of the roof can be reliably cut and broken. After all, the breaking away of cores left in the mine face is to be facilitated, too. To solve this object, the configuration according to the invention essentially consists in that at least one stationary cutter bit is arranged on the cantilever arm in the region of the bearings and/or gears between neighboring parts of the rolls or drums in a plane through which the axis of the cantilever arm passes, and that the cutter bit has at least two cutting edges, a first cutting edge being provided substantially tangential to the enveloping curve of the rotating bits in the direction of the axis of the cantilever arm and a second cutting edge being provided so as to enclose an angle with the first cutting edge. By arranging on the upper side of the cantilever arm in a substantially radial direction at least one bit having at least two cutting edges, whose external cutting edge is located substantially tangential to the enveloping curve of the rotating bits, it is feasible during penetration, i.e., while moving the cutter rolls into the mine face, to appropriately disintegrate the core left on the roof, to which end said bit comprises at least two cutting edges. As the cantilever arm carrying the cutter rolls is advanced, both the front edge adjacent the mine face and the bit edge located radially outwards and substantially tangential to the enveloping curve of the bits are entering into operation such that the core left on the roof can be reliably cut and broken. Since that bit is a stationary cutter bit, it may be fixed to the gear case or to the cantilever arm in a simple manner.

Advantageously, the configuration is devised such that the cutting edge in the direction of the axis of the cantilever arm is longer than the width of the bit transverse to the length of the cutting edge.

In order to ensure that at least the core remaining in the region of the roof can be reliably cut and broken, the configuration advantageously is devised such that the second cutting edge encloses an angle of 90°±45° with the first cutting edge.

Between such bits positioned in a substantially diametrically opposite relationship on a larger circumference, further bits may be arranged in the circumferential direction, which are to facilitate the breaking of cores left in the region of the mine face. To this end, the configuration advantageously is devised such that two substantially diametrically opposite bits are arranged on a larger circumference than further stationary bits facing the mine face, between parts of the rolls or drums, wherein said further bits arranged on a smaller radius preferably are arranged so as to be distributed over a central angle $\alpha$ of $90° \alpha < 150°$. The further bits arranged between the cutter bits for the roof or floor may readily be arranged on a smaller radius, since slender cores remaining in the region of the mine face may be broken away with little effort during further advance. In this respect, the configuration in a particularly simple manner may be devised in that the further bits are designed as parallel shank bits. The use of different types of bits for different partial regions of the peripheries of the core has proved to be of particular advantage, enabling to take into account to an optimum degree the different regions over which the cutter drums enter into operation. Particularly preferred is an embodiment in which wedge-shaped bits are arranged adjacent the bits comprising two cutting edges, the externally arranged cutting edges of which wedge-shaped bits are located on a smaller diameter than the bits having two cutting edges. Such wedge-shaped bits are provided for cutting in the transitional region between the roof and the mine face, wherein these bits may be arranged within the track of the externally arranged bits having at least two cutting edges or also offset relative to that track. Only in the central region, which relates to a central angle of about ±45° relative to the axis of the cantilever arm, may circular bits or parallel shank bits be employed in an advantageous manner, since in those cases the axial pressure exerted on the remaining cores in the form of a lumped load allows for an optimum disintegration performance and the simple breaking away of cores left in the region of the mine face.

In a particularly simple manner, the arrangement may be devised such that the bits are fixed to a gear lid or a stationary support connected with the gear lid.

BRIEF DESCRIPTION OF THE DRAWINGS

In the following, the invention will be explained in more detail by way of exemplary embodiments schematically represented in the drawing. Therein.

DETAILED DESCRIPTION OF PREFERRED EMBODIMENTS OF THE INVENTION

Figure 1:
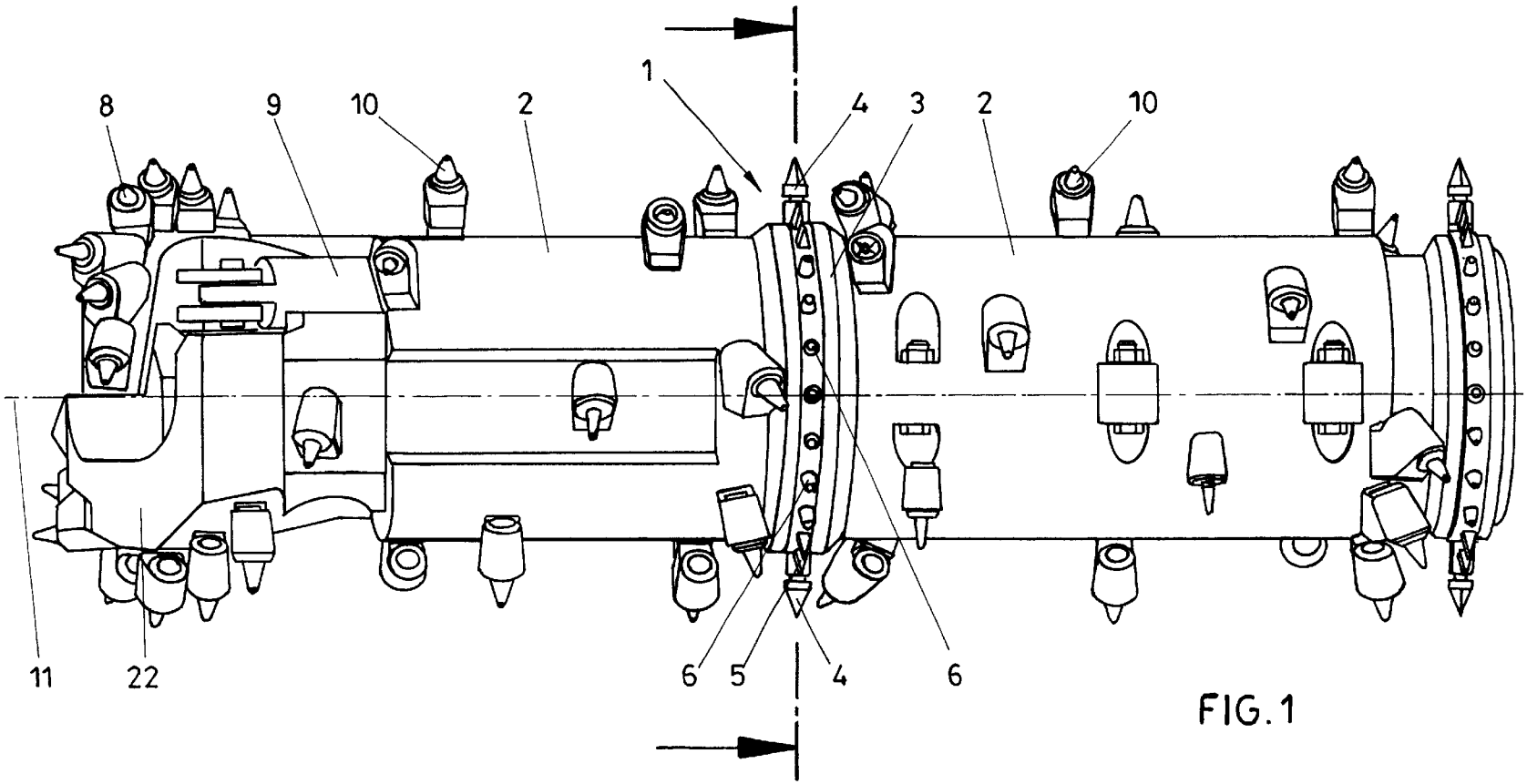
FIG. 1 is a perspective illustration of segments of a cutter roll showing the arrangement of the bits.

From FIG. 1 a cutter roll 1 is apparent, which is comprised of segments 2. Between neighboring segments, a stationary ring 3 is arranged, to which different bits 4, 5 and 6 are fixed. In the region of those bits 4, 5 and 6, there is also located that part of the transmission or bearing of the cantilever arm, which is not illustrated in FIG. 1. On the external end face of the drum segments 2, further bits 8 are arranged on pivotable supports 22 capable of being pivoted outwardly by means of a pivot drive schematically indicated by 9, in order to thereby enable the cutter roll to be widened, if need be. The bits provided on the roll or drum segments are schematically indicated by 10.

Figure 2:
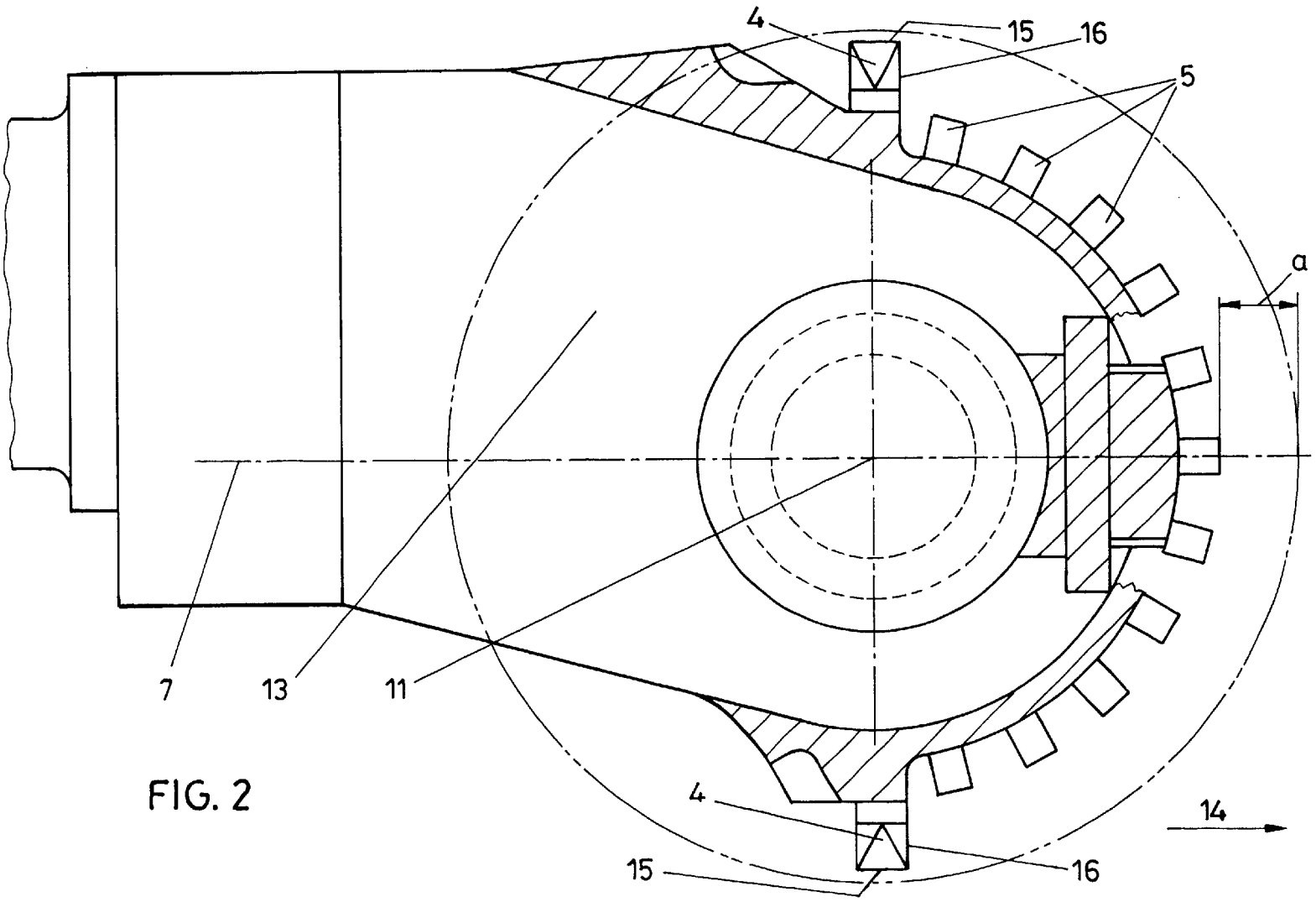
FIG. 2 is a sectional representation, viewed on the stationary bits in the direction of the axis of rotation of the roll or drum.

From the illustration according to FIG. 2, it is apparent that two externally located bits 4 in a diametrically opposite relationship are each arranged on a larger diameter, which corresponds to the diameter of the enveloping circle of the cutter bits provided on the rotatable roll parts, than the further bits 5 arranged between these bits 4 at a central angle. The axis of rotation of the drums is indicated by 11, the longitudinal axis of the cantilever arm again being schematically indicated by 7. The bearing part of the cantilever arm, on which the drum segments 2 are rotatably journalled, is denoted by 13 and may contain a gear. The bits 4 and 5 are stationarily fixed to the external side of this bearing part 13, or of the gear case. The bits 4 are arranged on a larger radius than the bits 5 such that the bits 4 are entering into operation in the region of the roof as the cantilever arm is displaced in the direction of the arrow 14. Likewise, the respective diametrically opposite cutting element or bit 4 will enter into operation upon penetration in the direction of the arrow 14. The bits 4 each have a substantially tangential outer cutting edge 15 and a substantially orthogonal further cutting edge 16 such that cutting and breaking of the remaining core will be feasible by such bits 4. Wedge-shaped cutting faces each follow upon the cutting edges 15 and 16.

The further stationary bits 5 are designed as wedge-shaped bits. Since these bits are arranged on a smaller radius, a core having a height schematically indicated by a in FIG. 2 is left in the region of the mine face.

Figure 3:
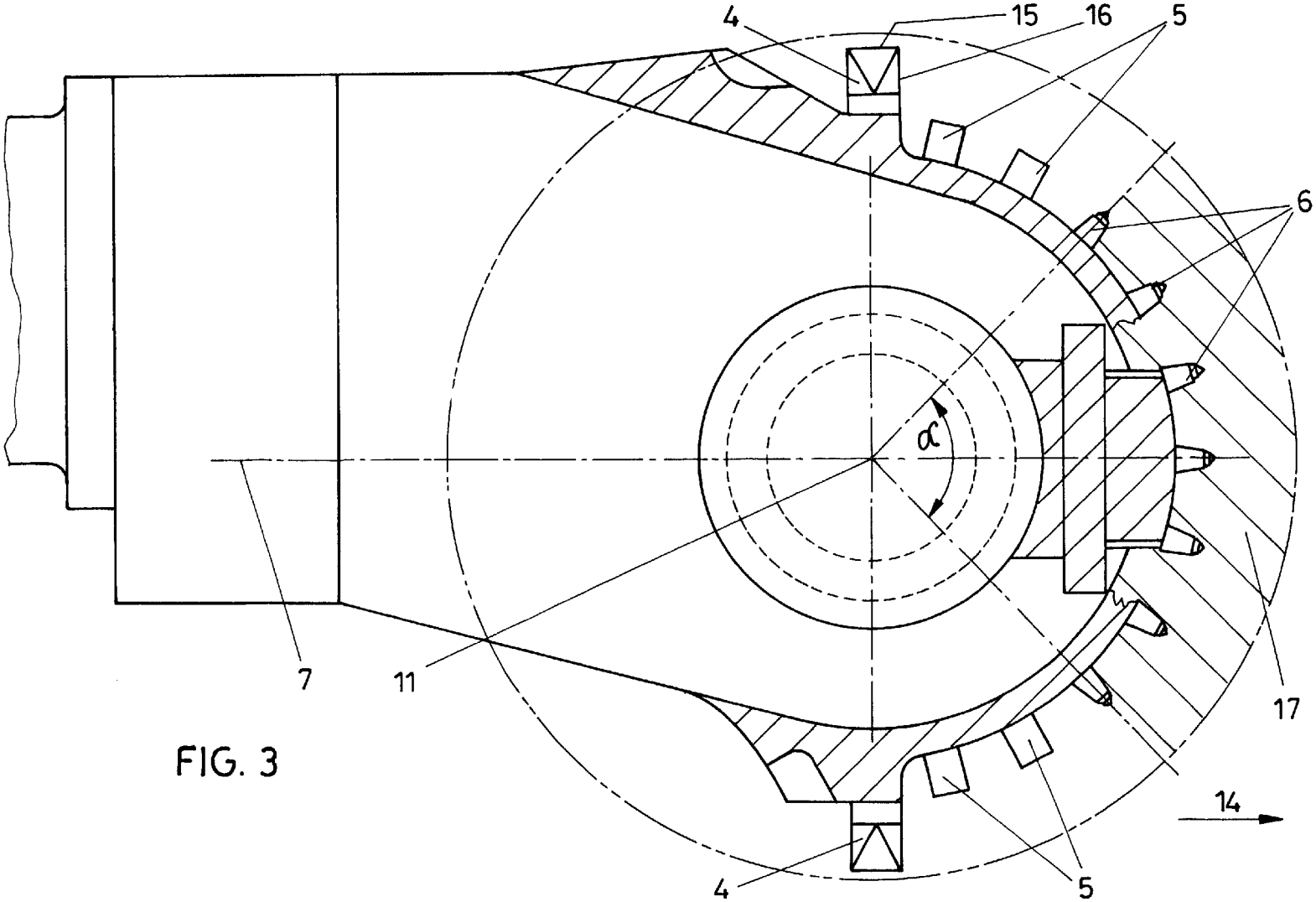
FIG. 3 is a modified embodiment of a representation corresponding to FIG. 2.

In the configuration according to FIG. 3, the wedge-shaped bits 5 are again visible beside the bits 4 having two substantially orthogonal cutting edges. Additional bits 6 extend over a central angle $\alpha$ of about 90° and are designed as parallel shank bits 6 breaking the core schematically indicated by 17 by exerting a lumped load when penetrating into said core. The bits 4 having the two substantially orthogonal cutting edges 15 and 16 are again arranged on a larger diameter so as to enter into action to the optimum degree during the advance movement in the direction of the arrow 14.

Figure 4:
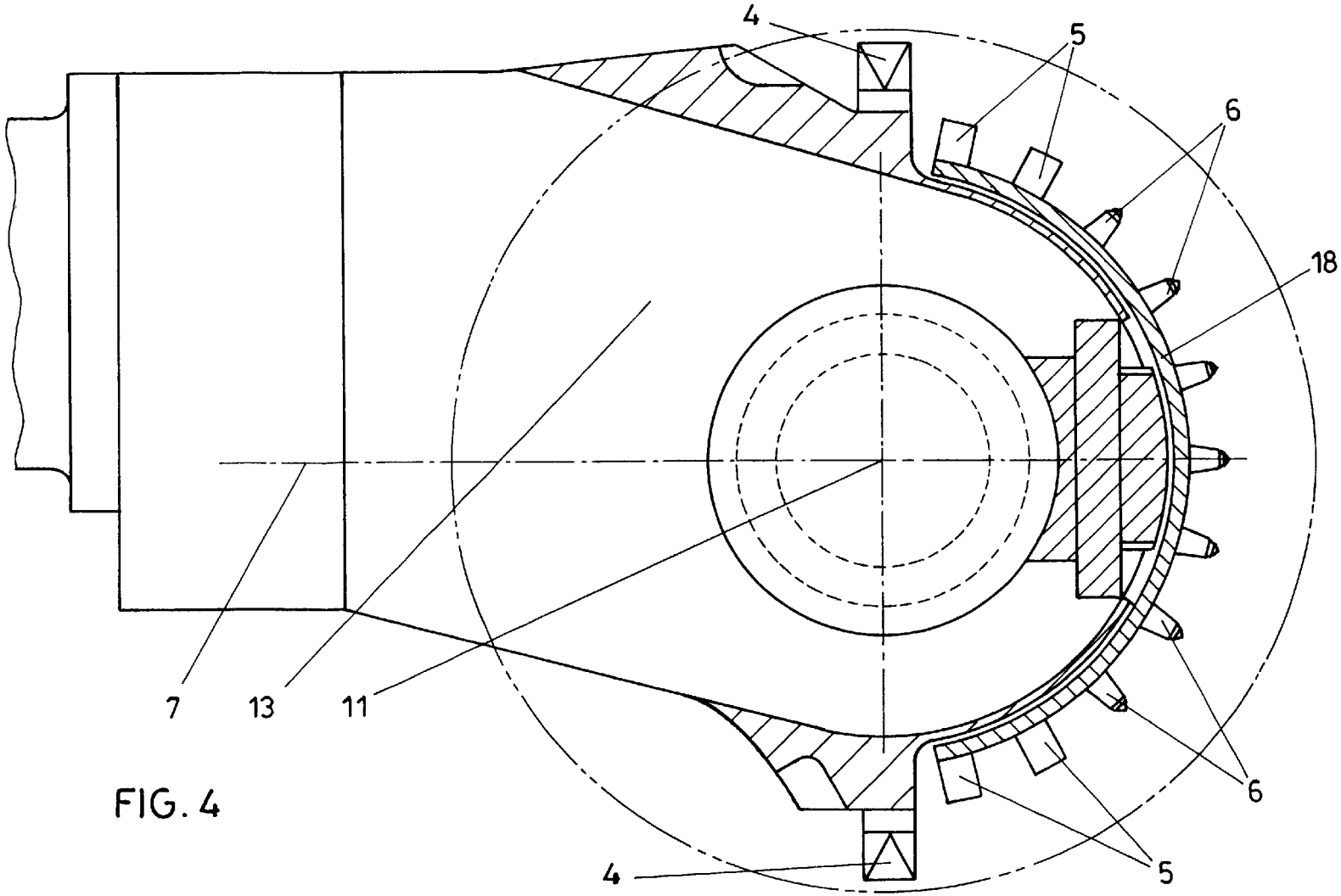
FIG. 4 is a further modified embodiment in an illustration corresponding to that of FIG. 2.

In the illustration according to FIG. 4, the bits 5 and 6 are mounted on a separate support 18 connected with the gear case. That support 18 may be fixed to the gear case 13 by screws not illustrated or may be welded with the gear case.

Figure 5:
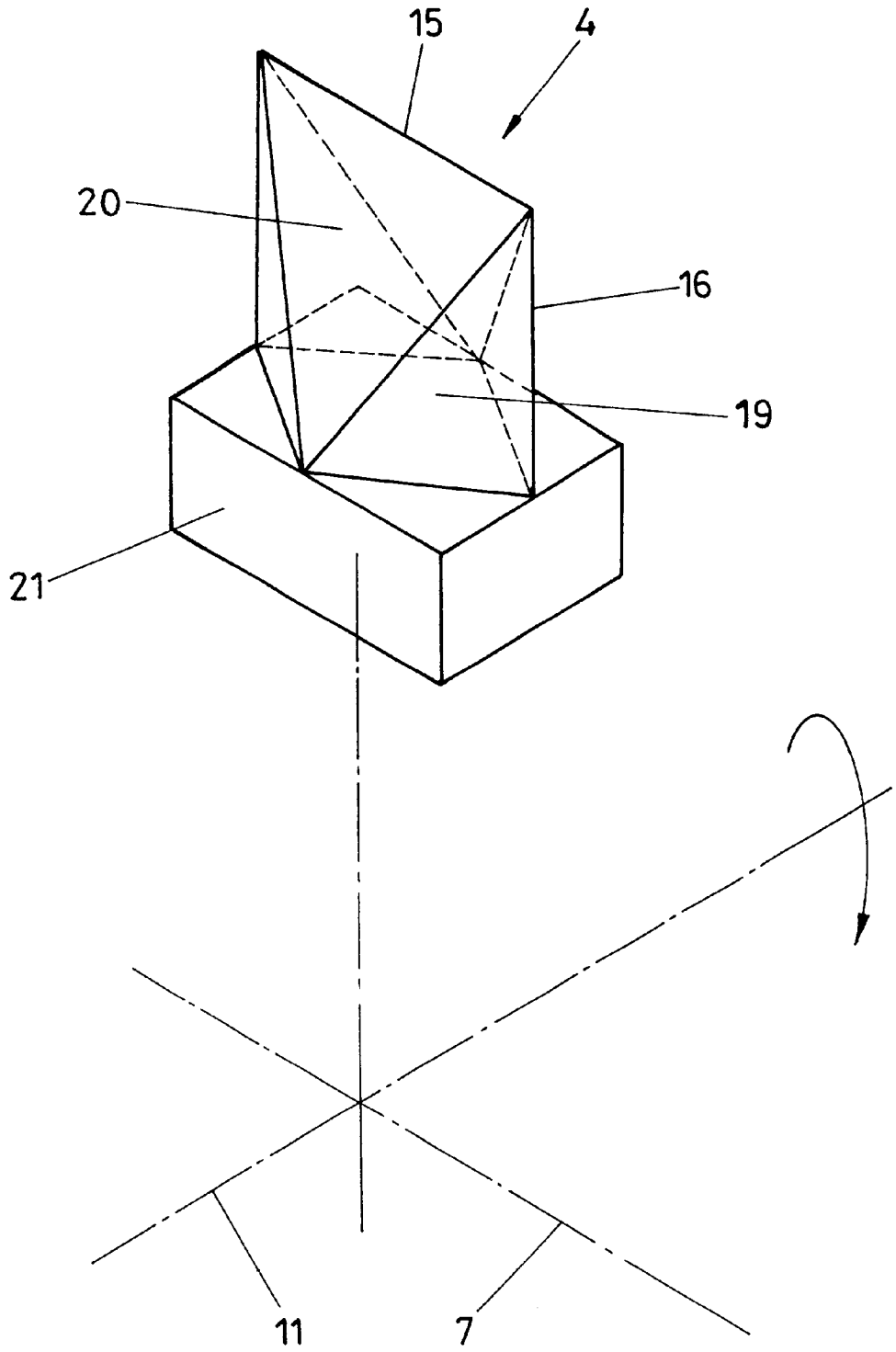
FIG. 5 is an enlarged illustration of the bit shape of an externally arranged bit having two cutting edges.

FIG. 5 depicts a bit 4 in an enlarged perspective illustration. The bit 4 comprises an external cutting edge 15 and a front cutting edge 16, wedged surfaces 19 and 20 each following upon these cutting edges 15 and 16. The wedged surfaces after the penetration of the cutting edges 16 and 15, respectively, cause the cut material to be split so as to substantially facilitate the breaking of the cores. The base portion of the bit 4 is denoted by 21 and may be welded or screwed with a suitable support.

What we claim is:

1. In a driving or mining machine of the type including cantilever arm mounted so as to be pivotable in the vertical direction and having a cantilever arm axis, a cutter roll or cutter drum mounted for rotation on said cantilever arm and composed of cutter roll or cutter drum segments, a plurality of bits arranged on said rotating cutting roll or cutter drum segments so as to define an enveloping curve, an actuating means provided in said cantilever arm, and at least one of a bearing means and a gear means arranged in the axial direction of said cutter roll or cutter drum between said cutter roll or cutter drum segments and connected with the respective one of said cantilever am and said actuating means, the improvement comprising at least one stationary cutter bit arranged on said cantilever arm in the region of said at least one of a bearing means and a gear means between neighboring cutter roll or cutter drum segments in a plane through which said cantilever arm axis passes, wherein said at least one stationary cutter bit has at least a first cutting edge and a second cutting edge, said first cutting edge being spaced from a longitudinal axis of said cutter roll or cutter drum segments by a distance substantially corresponding to the distance from said longitudinal axis to cutting edges of the bits which define said enveloping curve, and said second cutting edge being disposed at an angle with respect to said first cutting edge.

2. A driving or mining machine as set forth in claim 1, wherein said stationary cutter bit has a stationary cutter bit width transverse to the length of each one of said at least first and second cutting edges and wherein said first cutting edge has a cutting edge length in the direction of said cantilever arm axis, said cutting edge length in the direction of said cantilever arm axis being larger than said stationary cutter bit width transverse to the length of each one of said at least first and second cutting edges.

3. A driving or mining machine as set forth in claim 1, wherein said second cutting edge is disposed at an angle of 90°±45° with respect to said first cutting edge.

4. A driving or mining machine as set forth in claim 1, comprising, between said cutter roll or cutter drum segments, two stationary cutter bits arranged in a substantially diametrically opposite relationship and further stationary bits arranged so as to face the mine face, and wherein a first diameter is defined for arrangement of said two stationary cutter bits and a second diameter is defined for arrangement of said further stationary bits, said first diameter being larger than said second diameter.

5. A driving or mining machine as set forth in claim 4, wherein said further stationary bits arranged on said second diameter are distributed over a central angle $\alpha$ of $90° < \alpha < 150°$.

6. A driving or mining machine as set forth in claim 4, wherein said further stationary bits are designed as bits having shanks of circular cross-section.

7. A driving or mining machine as set forth in claim 4, wherein of said further stationary bits those arranged adjacent said cutter bits having said first and second cutting edges are designed as wedge-shaped cutter bits each having an external cutting edge located on a smaller diameter than said cutter bits having said first and second cutting edges.

8. A driving or mining machine as set forth in claim 1, further comprising a gear lid and wherein said cutter bits are fixed to said gear lid.

9. A driving or mining machine as set forth in claim 4, further comprising a gear lid and wherein said further stationary bits are fixed to said gear lid.

10. A driving or mining machine as set forth in claim 1, further comprising a gear lid and a stationary support connected with said gear lid, and wherein said cutter bits are fixed to said stationary support.

11. A driving or mining machine as set forth in claim 4, further comprising a gear lid and a stationary support connected with said gear lid, and wherein said further stationary bits are fixed to said stationary support.

* * * * *

UNITED STATES PATENT AND TRADEMARK OFFICE

CERTIFICATE OF CORRECTION

PATENT NO. : 6,315,365 B1 
DATED : November 13, 2001
INVENTOR(S) : Roman Gerer, Eduard Krivec and Kurt Schaffer It is certified that error appears in the above-identified patent and that said Letters Patent is hereby corrected as shown below:

Title page,
Item [73], assignee information should appear as follows:
-- [73] Assignee: Tamrock Voest-Alpine Bergtechnik Gesellschaft m.b.H. (AT) --

Signed and Sealed this

Twenty-fourth Day of September, 2002

*Attest:*

*Attesting Officer*

JAMES E. ROGAN
*Director of the United States Patent and Trademark Office*